US010207776B1

(12) United States Patent
Downey et al.

(10) Patent No.: US 10,207,776 B1
(45) Date of Patent: Feb. 19, 2019

(54) SEAT AND SEAT ASSEMBLY FOR USE IN A BOAT

(71) Applicant: Brunswick Corporation, Lake Forest, IL (US)

(72) Inventors: Kevin T. Downey, Rockford, MI (US); Timothy M. Kramer, Saint Johns, MI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/693,718

(22) Filed: Sep. 1, 2017

(51) Int. Cl.
*B63B 29/04* (2006.01)
*B63B 29/06* (2006.01)

(52) U.S. Cl.
CPC ..... *B63B 29/04* (2013.01); *B63B 29/06* (2013.01); *B63B 2029/043* (2013.01); *B63B 2709/00* (2013.01)

(58) Field of Classification Search
CPC .... A47C 7/00; A47C 9/00; A47C 9/10; A47C 7/02; B63B 17/00; B63B 29/04; B63B 29/06
USPC ..... 114/363
See application file for complete search history.

(56) References Cited

U.S. PATENT DOCUMENTS 4,060,279 A 11/1977 Vogel
4,869,551 A * 9/1989 Lathers ..... B63B 29/04 114/363
6,736,084 B2 5/2004 McDonough et al.
7,347,499 B2 * 3/2008 Slabaugh ..... B63B 29/04 297/284.11
7,913,637 B2 3/2011 Roehm, II et al.
8,123,293 B2 2/2012 Marriott et al.
8,590,478 B2 * 11/2013 Lipman ..... B63B 35/79 114/363
8,647,544 B2 2/2014 Burch
8,707,885 B2 4/2014 Nguyen
8,757,717 B2 6/2014 Funk et al.
8,894,147 B2 11/2014 Micheli
9,272,640 B2 3/2016 Masters et al.
9,381,840 B2 7/2016 Tobata et al.
(Continued)

OTHER PUBLICATIONS

Attwood, "Centric Seating System", installation instructions, 2004, available at http://www.attwoodmarine.com/userfiles/store/product/files/936/69341-c-centric-seats.pdf.
(Continued)

*Primary Examiner* — Lars A Olson
(74) *Attorney, Agent, or Firm* — Andrus Intellectual Property Law, LLP

(57) ABSTRACT

A seat is designed for use in a boat and extends in a vertical height direction, a lateral width direction, and a depth direction perpendicular to the width direction. The seat includes a pan main body extending in at least the width direction and the depth and a back main body coupled to the pan main body and extending in at least the width direction and the height direction. The pan main body and/or the back main body is formed from a single extrusion having a uniform cross section in one if the height, width, and depth directions. The pan main body and/or the back main body has an open profile when viewed in the one of the height, width, and depth directions. The open profile is configured to accept and hold a further seat component therein.

19 Claims, 6 Drawing Sheets

(56) References Cited

U.S. PATENT DOCUMENTS

| | | | | |
|---|---|---|---|---|
| 2008/0251001 | A1* | 10/2008 | Draghici | B63B 29/06 114/363 |
| 2009/0184562 | A1 | 7/2009 | Wilson et al. | |
| 2009/0189433 | A1 | 7/2009 | Wilson et al. | |
| 2010/0176620 | A1 | 7/2010 | Micheli | |
| 2014/0375090 | A1 | 12/2014 | Wegenka et al. | |
| 2015/0329030 | A1 | 11/2015 | Wiegelmann et al. | |
| 2016/0311344 | A1 | 10/2016 | Smith et al. | |

OTHER PUBLICATIONS

Attwood, "Marine Products Catalog: Seating Systems", online catalog, 2016, available at http://www.attwoodmarine.com/userfiles/file/Catalog/2016_catalog/2016_Catalog_6-Seating.pdf.

* cited by examiner

SEAT AND SEAT ASSEMBLY FOR USE IN A BOAT

FIELD

The present disclosure relates to seats and seat assemblies that can be used on board a boat.

BACKGROUND

Those having skill in the art are familiar with the America Boat and Yacht Council (ABYC) Standards for seating hardware. For instance, operator seats and non-operator seats have different design requirements depending on the threshold speeds under which they are to be occupied. A seat in a boat must be capable of sustaining impact and static loads for particular amounts of time, as well as capable of sustaining torque in the event that the seat is swivel-able. Both strength and durability are required of a given seat substructure in order to meet such safety codes.

Current seats on the market use defined injection molded, rotational-molded, blow-molded, or multi-material (wood, aluminum, composite) fabricated seat substructures, which limit long-term design flexibility of the seat. For example, different molds are required to provide different types, shapes, and/or sizes of seats. It is difficult for seat designers to justify the large investment required to develop a seat for a boat that does not provide customers with long term design and size flexibility.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a seat is designed for use in a boat and extends in a vertical height direction, a lateral width direction, and a depth direction perpendicular to the width direction. The seat includes a pan main body extending in at least the width direction and the depth and a back main body coupled to the pan main body and extending in at least the width direction and the height direction. At least one of the pan main body and the back main body is formed from a single extrusion having a uniform cross section in one of the height, width, and depth directions. At least one of the pan main body and the back main body has an open profile when viewed in the one of the height, width, and depth directions. The open profile is configured to accept and hold a further seat component therein.

According to another example of the present disclosure, a seat assembly is designed for use in a boat and extends in a vertical height direction, a lateral width direction, and a depth direction perpendicular to the width direction. A pan main body extends in at least the width direction and the depth direction. The pan main body is formed from a first single extrusion having a first uniform cross section in a first one of the height, width, and depth directions. A back main body is coupled to the pan main body and extends in at least the width direction and the height direction. The back main body is formed from a second single extrusion having a second uniform cross section in a second one of the height, width, and depth directions.

BRIEF DESCRIPTION OF THE DRAWINGS

Examples of seats and seat assemblies are described with reference to the following Figures. The same numbers are used throughout the Figures to reference like features and like components.

DETAILED DESCRIPTION OF THE DRAWINGS

In the present description, certain terms have been used for brevity, clarity and understanding. No unnecessary limitations are to be implied therefrom beyond the requirement of the prior art because such terms are used for descriptive purposes only and are intended to be broadly construed. The different assemblies described herein may be used alone or in combination with other assemblies. Various equivalents, alternatives, and modifications are possible.

Figure 1:
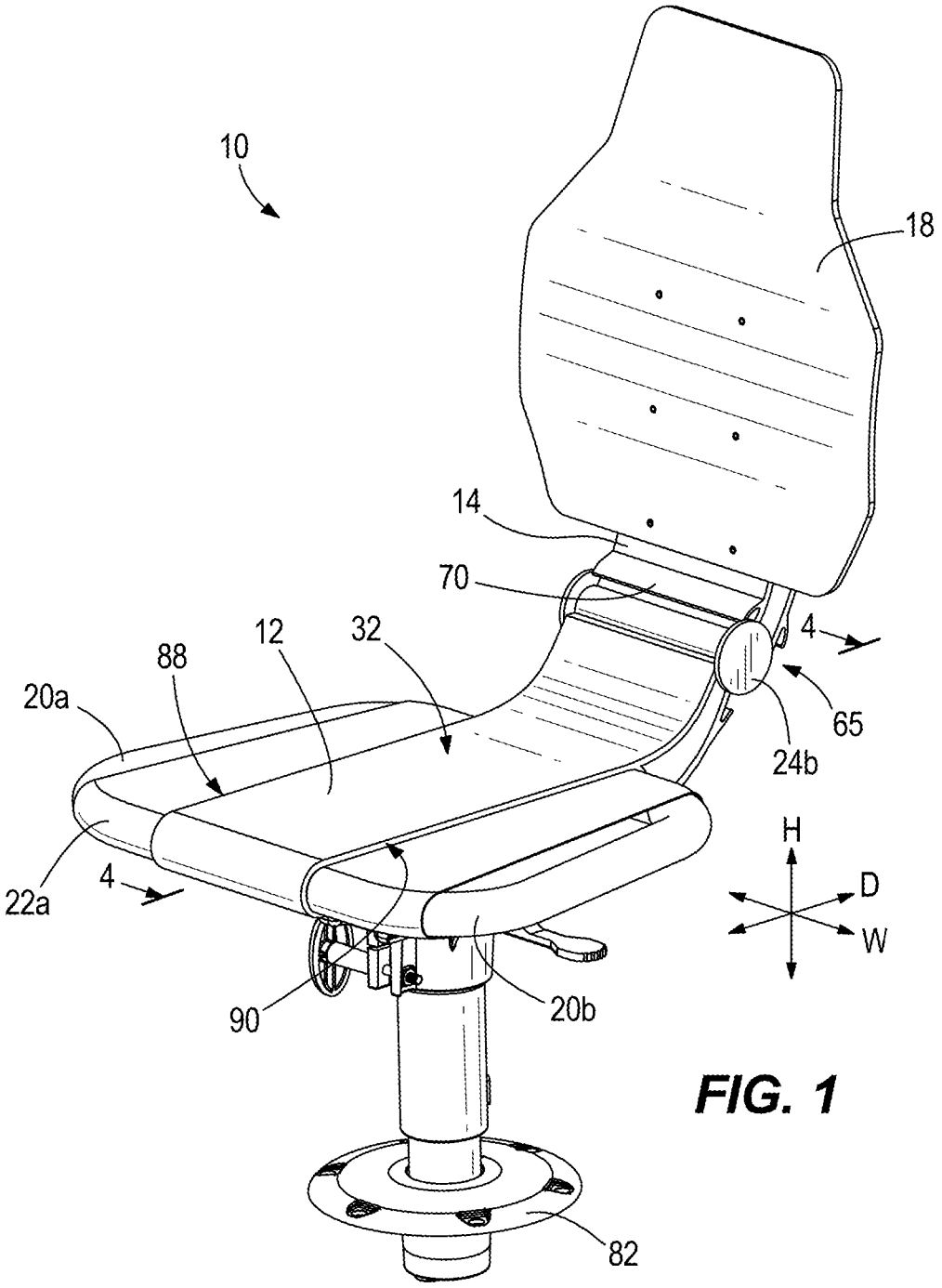
FIG. 1 illustrates a front perspective view of a seat assembly according to the present disclosure.
Figure 2:
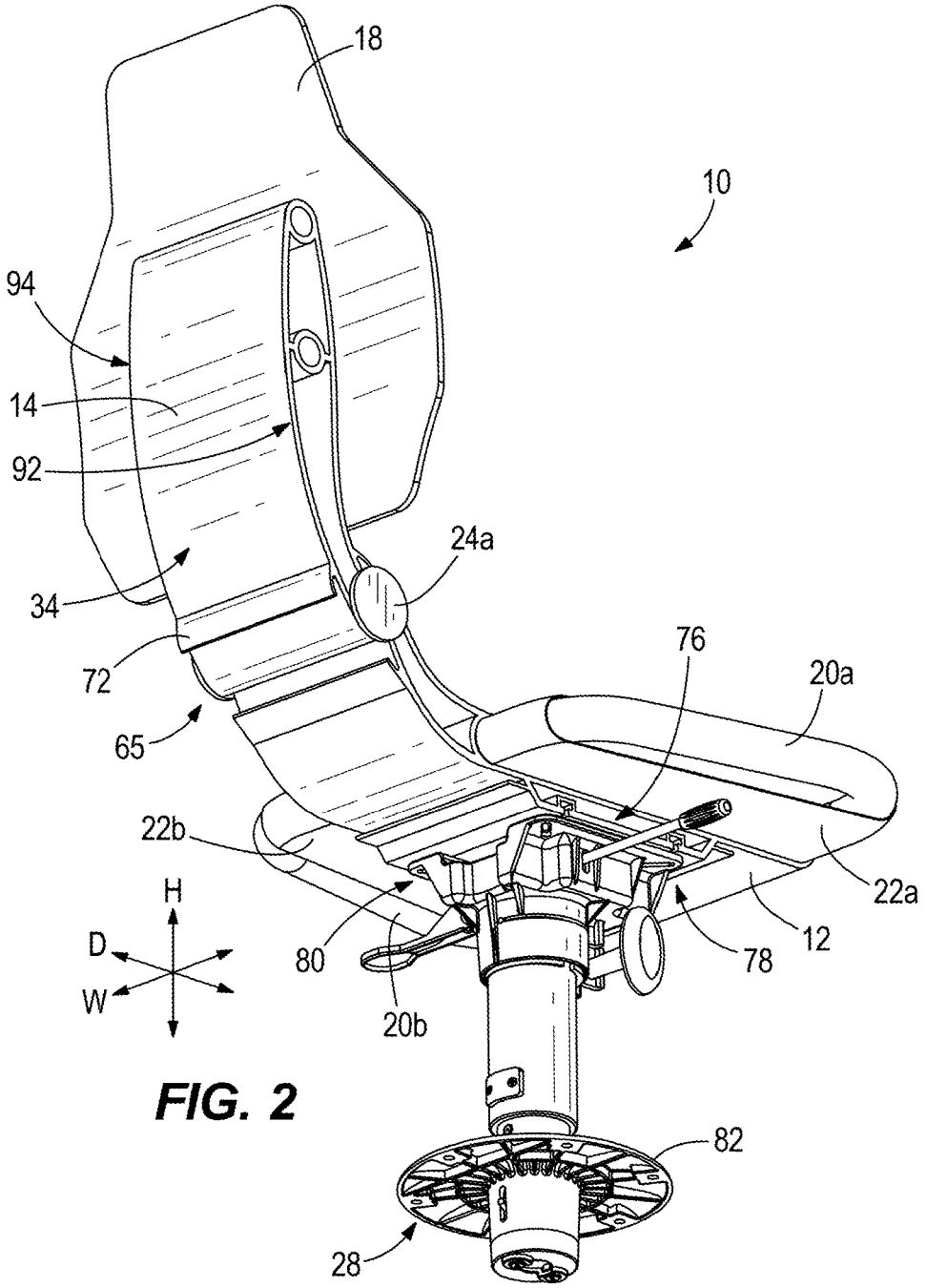
FIG. 2 illustrates a rear perspective view thereof.
Figure 3:
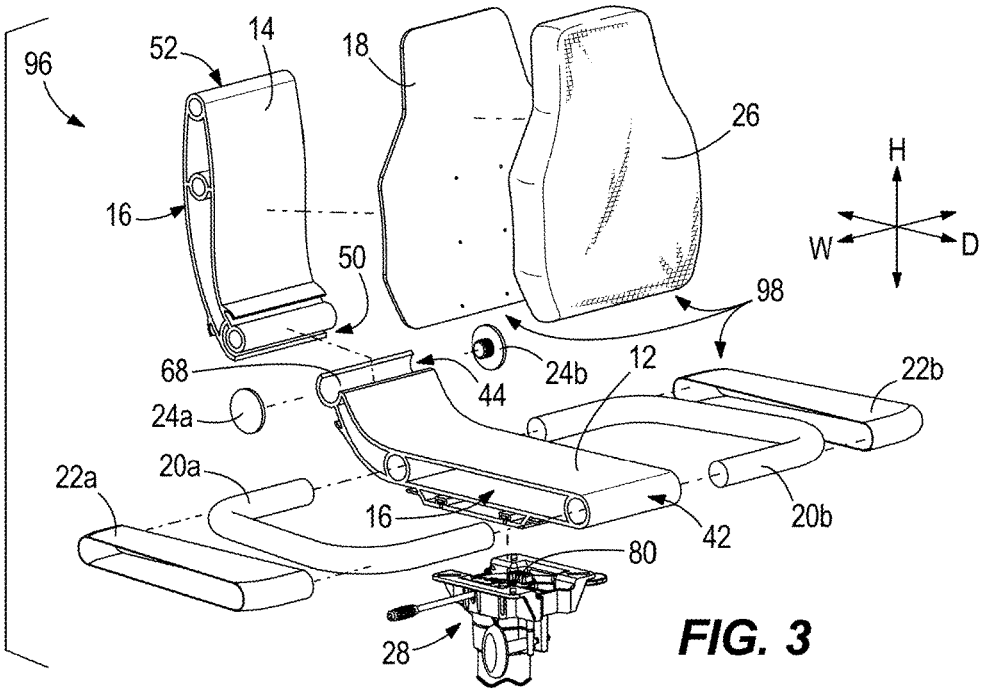
FIG. 3 illustrates an exploded view of the seat assembly.

FIGS. 1-3 illustrate a first embodiment of a seat 10 that can be used in a boat, such as but not limited to a fishing boat, a pontoon, a yacht, etc. The seat 10 extends in a vertical height direction H, a lateral width direction W, and depth direction D perpendicular to the width direction W. The seat 10 includes a pan main body 12 that extends at least in the width direction W and the depth direction D. The pan main body 12 also includes a first wall 38 and a second wall 40 (FIG. 4) that are separated from one another in the height direction H, as will be described further herein below. The seat 10 also includes a back main body 14 that is coupled to the pan main body 12 and extends in at least the width direction W and the height direction H. The back main body 14 also includes a first wall 46 and a second wall 48 (FIG. 4), which are separated from one another in the depth direction D when the back main body is in an upright position, as shown in FIGS. 1 and 2, which will also be described further herein below. The pan main body 12 and the back main body 14 can be coupled together by way of being formed as a single integral extrusion, by being attached by first and second hinge portions that are integral with each of the pan main body 12 and the back main body 14, or by being attached by hinge portions that are separable from the pan main body 12 and the back main body 14. Alternatively, the pan main body 12 and the back main body 14 can be connected by a non-rotatable integral or separable joint.

According to the present disclosure, at least one of the pan main body 12 and the back main body 14 is formed from a single extrusion having a uniform cross section in one of the height direction H, the width direction W, and the depth direction D. This allows the at least one of the pan main body 12 and the back main body 14 to be cut to length post-extrusion to accommodate an array of customer seating needs. Further, at least one of the pan main body 12 and the back main body 14 has an open profile 16 (FIG. 3) when viewed in the one of the height direction H, the width direction W, and the depth direction D. The open profile 16 is configured to accept and hold a further seat component therein. According to the present disclosure, at least one of the pan main body 12 and the back main body 14 is both formed from the extrusion and has the open profile 16, and the cross section of the extrusion defines the open profile 16. Although the open profile 16 is shown only on one side of each of the pan main body 12 and the back main body 14 in FIG. 3, it is noted that the opposite sides of the pan main body 12 and the back main body 14 are mirror images of the sides that are shown (by virtue of the nature of an extrusion) and therefore also include the open profile 16. An extrusion that forms the pan main body 12 could have the same cross section as an extrusion that forms the back main body 14, thereby allowing the same die to be used for both bodies.

In fact, referring further to FIG. 3, a seat assembly 96 can include a plurality of further seat components 98 that are configured to be accepted and held by the open profile 16. The further seat components in the plurality of further seat components 98 include at least one of the following: a back panel 18, a side rail 20*a* or 20*b*, an elastic seat suspension 22*a* or 22*b*, a plug 24*a* or 24*b* (FIGS. 1 and 2), and a cover fabric 26. Although the cover fabric 26 is shown only for the back panel 18, it should be understood that a cover fabric could also be provided for the pan main body 12, side rails 20*a*, 20*b*, and elastic seat suspensions 22*a*, 22*b*. Other further seat components can be provided, such as grab handles, arm rests, etc. The seat assembly 96 also includes a pedestal assembly 28 configured to support the pan main body 12, and extending at least in the height direction H. Any of the further seat components 98 need not be provided depending on the width of the pan main body 12 and back main body 14, the level of comfort desired of the seat 10, and/or design aesthetics. For example, the pedestal assembly 28 might not be needed if the vessel is designed such that the pan main body 12 can be attached directly to a mounting area that is integral with the vessel, such as with common bench seating applications. In another example, all of the further seat components 98 are provided on a single seat 10.

Figure 4:
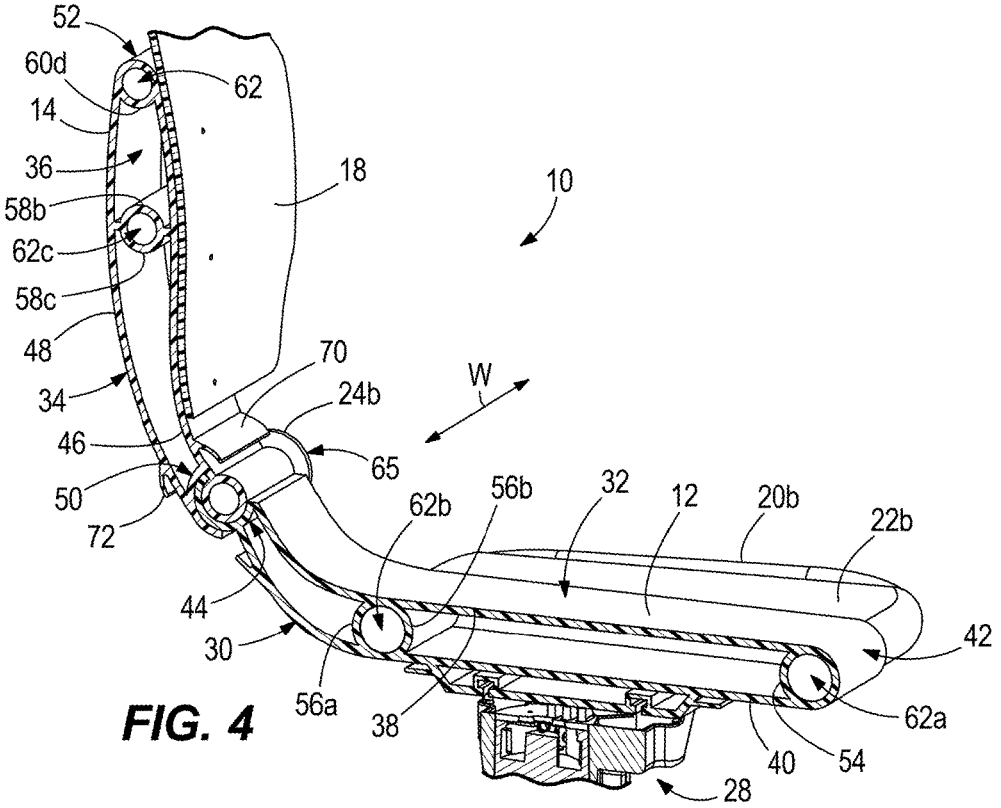
FIG. 4 illustrates a cross sectional view of a portion of the seat assembly.

Referring now to FIGS. 1, 2, and 4, the pan main body 12 is formed from a first single extrusion 32 having a first uniform cross section in a first one of the height direction H, the width direction W, and the depth direction D. In the present example, the first extrusion 32 extends in the width direction W. The pan main body 12 has a first open profile 30 when viewed in the first one of the height direction H, the width direction W, and the depth direction D. In the present example, the first open profile 30 is viewable from the width direction W. In fact, the first cross section of the first extrusion 32 defines the first open profile 30. The back main body 14 is formed from a second single extrusion 34 having a second uniform cross section in a second one of the height direction H, the width direction W, and the depth direction D. In the present example, the second extrusion 34 also extends in the width direction W. The back main body 14 has a second open profile 36 when viewed in the second one of the height direction H, the width direction W, and the depth direction D. In the present example, the second open profile 36 is viewable from the width direction W. The second cross section of the second extrusion 34 defines the second open profile 36. In the present example, because the first and second extrusions 32, 34 are extruded in the width direction W, they can be cut to any desired length, which thereafter defines the width of the main body 12 or 14 in question. The open profile 30 or 36 is defined wherever the cut along the extrusion 32 or 34 is made. Because the cross section along the main body 12 or 14 is uniform in the width direction, the shape of the open profile 30 or 36 at the cut is the same no matter where the cut is made. Supposing the extrusion were instead uniform in the height or depth direction, the extrusion could be cut to a desired length after forming, which would correspond to a height, width, or depth of a given seat component, depending on the in-use orientation of the extruded component with respect to the directions designated herein above.

The at least one of the pan main body 12 and the back main body 14 that is formed from the extrusion 32, 34, respectively, has a first wall and an opposing second wall that together define the open profile 30, 36 respectively. More specifically, the first extrusion 32 defining the pan main body 12 has a first wall 38 and second wall 40. The first open profile 30 is further defined at a front end 42 of the pan main body 12 and a rear end 44 of the pan main body 12, where the first wall 38 and second wall 40 are joined together. The back main body 14 has a first wall 46 and an opposing second wall 48 that together define the second open profile 36, and which are connected at a lower end 50 of the back main body 14 and at an upper end 52 of the back main body 14.

Both of the extrusions 32, 34 defining the pan main body 12 and the back main body 14, respectively, include reinforcing ribs within the open profiles 30, 36, which reinforcing ribs extend between the first wall 38 the second wall 40 and between the first wall 46 and the second wall 48, respectively. For example, pan main body 12 includes reinforcing rib 54 in the form of a semi-cylinder at front end 42 and reinforcing ribs 56*a*, 56*b* closer to the rear end 44 of the pan main body 12 than to the front end 42. Each of the reinforcing ribs 56*a*, 56*b* is in the form of a semi-cylinder, and together the reinforcing ribs 56*a*, 56*b* form a cylindrical body that extends along the width direction W of the pan main body 12. Similarly, back main body 14 includes reinforcing ribs 58*a*, 58*b*, which are also connected to form a cylinder running in the width W direction of the back main body 14, and another reinforcing rib 60 at the upper end 52 of the back main body 14, which is in the form of a semi-cylinder. The reinforcing ribs 54, 56*a*, 56*b*, 58*a*, 58*b*, 60 are each integrally formed as parts of the extrusions 32, 34, respectively, and therefore extend along an entirety of the width of the respective pan main body 12 and back main body 14. The reinforcing ribs 54, 56*a*, 56*b*, 58*a*, 58*b*, 60 at least in part define receiving areas 62*a*, 62*b*, 62*c*, 62*d* for holding the above-mentioned further seat components 98. The reinforcing ribs, and thus the receiving areas, could be shaped differently, spaced differently, or different in number than those shown herein. For example, the reinforcing ribs could be tubes crushed into fours points in an "X" shape, triangular tubes, rectangular tubes, hexagonal tubes, octagonal tubes, etc.

Figure 5:
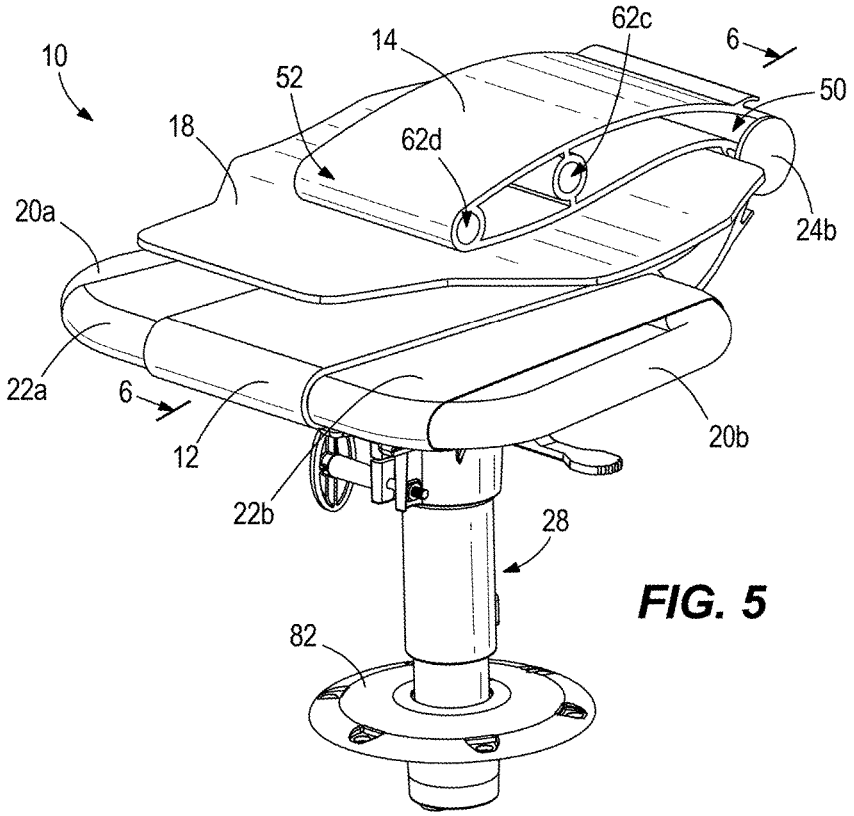
FIG. 5 illustrates the seat assembly in a folded position.
Figure 6:
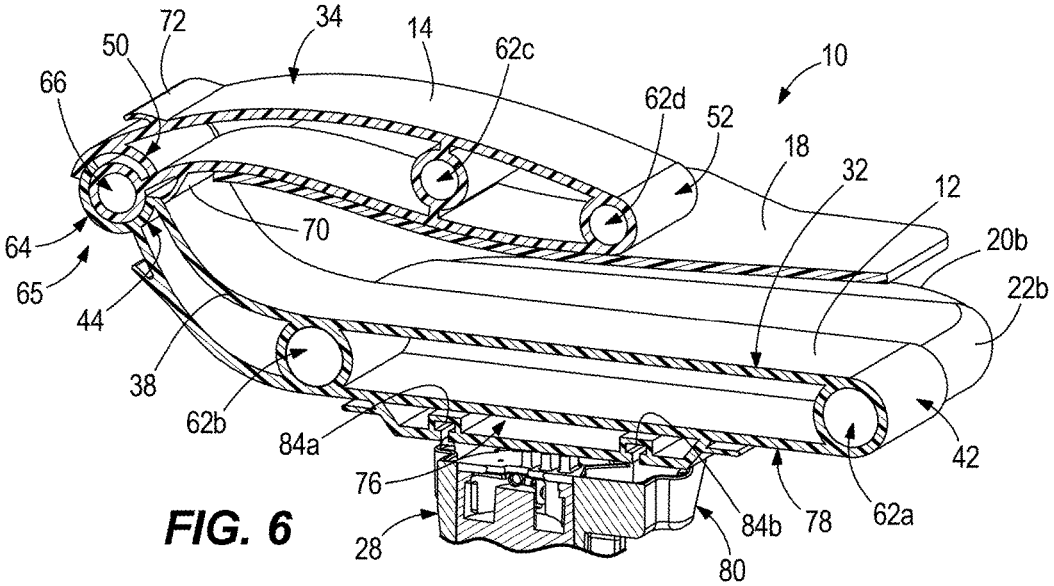
FIG. 6 illustrates a cross sectional view of the seat assembly in the folded position.

Comparisons of FIGS. 1, 2, and 4 with FIGS. 5 and 6 illustrate how the seat 10 is foldable from a position in which the back main body 14 and back panel 18 are generally upright and extend in the vertical direction V to a position in which the back main body 14 and back panel 18 are generally horizontally disposed and hover over (or rest on) the pan main body 12 and other pan components, such as the side rails 20*a*, 20*b* and elastic seat suspensions 22*a*, 22*b*. Thus, when it is described herein above how the back main body 14 extends in the vertical direction V, it should be understood that this occurs in a given position of the back main body 14 and does not necessarily mean that the back main body 14 cannot be moved to various other positions.

Pivoting of the back main body 14 can be enabled by way of overcoming a detent or spring load provided near the pivot point, or can be allowed only after a lever on the pedestal assembly 28 has been actuated so as to unlock the position of the back main body 14.

FIG. 6 illustrates the details of a hinge 65 that can be provided between the back main body 14 and the pan main body 12. The hinge 65 includes a first hinge portion 64 formed integrally at the rear end 44 of the first extrusion 32. The hinge 65 also includes a second hinge portion 66 formed integrally at the lower end 50 of the second extrusion 34. The first and second hinge portions 64, 66 fit together to pivotally couple the back main body 14 to the pan main body 12. One of the first hinge portion 64 and the second hinge portion 66 is formed as a groove extending in the width direction W, and the other of the first hinge portion 64 and the second hinge portion 66 is complementary to and fits within the groove. Here, referring also to FIG. 3, the first hinge portion 64 on the first extrusion 32 of the pan main body 12 comprises the groove 68. The groove 68 in this example is semi-cylindrical and receives the cylindrical second hinge portion 66 at the lower end 50 of the second extrusion 34 therein. The outer diameter of the cylindrical second hinge portion 66 is slightly smaller than the inner diameter of the first hinge portion 64, such that the second hinge portion 66 can rotate within the groove 68 of the first hinge portion 64. To couple the pan main body 12 and back main body 14 together, the second hinge portion 66 can be slid in the width direction W into the first hinge portion 64, by way of the first open profile 30. It should be understood that the groove could instead be provided at the lower end 50 of the second extrusion 34 of the back main body 14 and the cylindrical hinge portion could be provided at the rear end 44 of the first extrusion 32 of the pan main body 12. The inside of the second hinge portion 66 may be hollowed out, as shown here, in order to provide receiving areas on each side thereof for receiving the plugs 24*a*, 24*b*. In another example, the hinge portions 64, 66 have areas that are oppositely machined out in the width direction to form knuckles, such that the machined-out areas of the first hinge portion 64 can accept the non-machined-out knuckles of the second hinge portion 66, and vice versa, as with a conventional hinge design. A connecting pin can be inserted into the hollow knuckles of the hinge portions 64, 66 to hold them together.

In another example, the hinge between the back main body 14 and the pan main body 12 is a separate component that is not integral with either of the back main body 14 or the pan main body 12. For example, the hinge could be a conventional hinge such as a butt hinge, a piano hinge, a slip joint hinge, a flag hinge, etc. that is adhered, fastened onto, inserted into, or otherwise coupled between the back main body 14 and the pan main body 12. The hinge could be spring-biased so that the back main body 14 tends to stay in its current folded or raised position unless force of a certain magnitude is applied against the spring load.

In still another example, no hinge is provided between the back main body 14 and the pan main body 12. The bodies could be integral with one another, or they could be connected via a non-rotatable joint. The non-rotatable joint could have halves that are integral with each of the back main body 14 and the pan main body 12. Alternatively, the non-rotatable joint could be a separate component that is attached between the back main body 14 and the pan main body 12.

Although not shown herein, one further seat component that could be attached to the outer face of the second wall 48 of the back main body 14 is a plate-like component having cup holders and a tray area or serving as a step to allow a boater to walk on top of the seat 10 when the seat 10 is in the folded position.

In another example, the pan main body 12 and the back main body 14 are together formed from one single extrusion. In this example, the hinge 65 would not be as shown herein, but instead might be non-existent (i.e., the seat back cannot fold down) or may be a living hinge.

Various other aspects of the extrusions 32, 34 could enhance the aesthetics and/or functionality of the pan main body 12 and back main body 14. For instance, referring to FIGS. 4 and 6, a fin 70 could be provided on the first wall 46 of the second extrusion 34 proximate the lower end 50 of the back main body 14. The fin 70 could be designed to contact the first wall 38 of the pan main body 12 when the seat 10 is in the folded position shown in FIG. 6. This would then prevent further rotation of the back main body 14 closer to the pan main body 12 and could potentially prevent over-rotation of the hinge 65. (Note that a cushion or cover fabric could be provided over both the back main body 14 and back panel 18 and over the pan main body 12, such that the cushion and cover fabric contacted one another when the seat 10 was in the folded position. Other fins, such as that shown at 70 and 72 could be included in order to provide attachment points for the cover fabric and/or cushioning material.

Referring to FIGS. 2 and 6, the pan main body 12 may include an attachment area 76 that is formed integrally at a bottom side 78 of the first extrusion 32. The attachment area 76 is configured to receive and be coupled to an upper end 80 of the pedestal assembly 28. In this manner, the seat 10 can be coupled to the boat by way of a base 82 of the pedestal assembly 28 being bolted to the deck of the boat, and the upper end 80 of the pedestal assembly 28 being slid into and fastened to the attachment area 76 of the first extrusion 32. The attachment area 76 can include two T-shaped slots 84*a*, 84*b*, which are part of the first extrusion 32, that are configured to receive an attachment mount on existing pedestal assemblies. Note that slots or apertures having a shape other than that shown could alternatively be provided, so long as they accommodate the attachment mount on the existing pedestal assembly. As is known, the pedestal assembly 28 can then be fastened to the attachment area 76. The attachment area 76, which is part of the first extrusion 32 of the pan main body 12, replaces the metal and/or wood construction on the underside of current seats that is required to connect the seat to the die cast attachment mount of current pedestal assemblies. In another example, the attachment area 76 can be connected directly to a designated area of the vessel, such as with a bench seating application.

Figure 7:
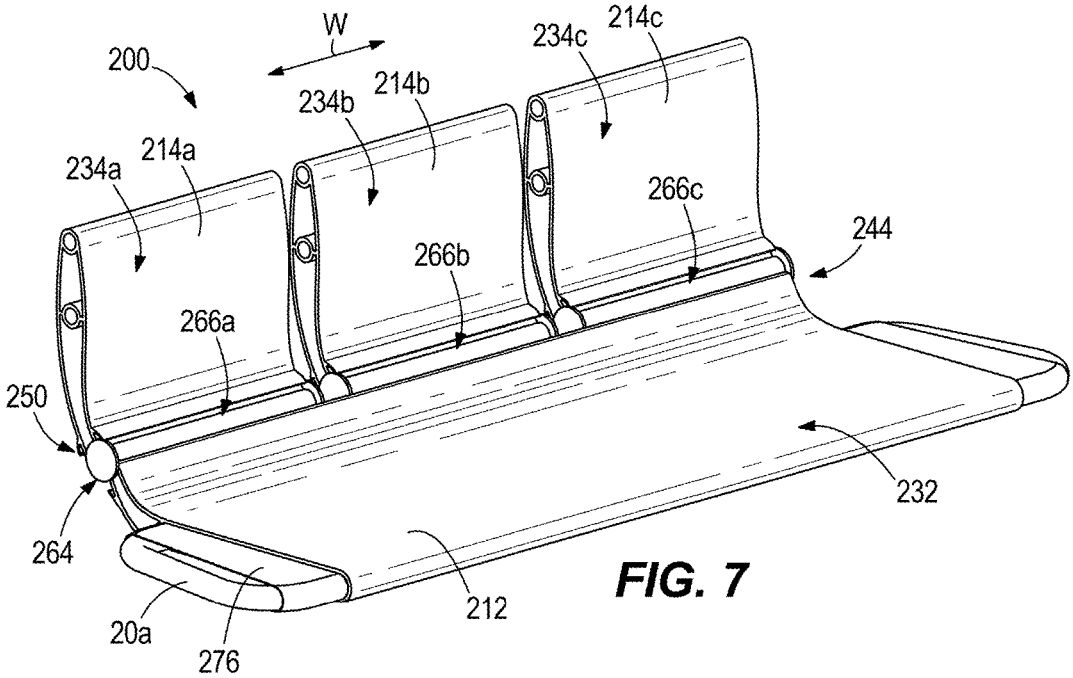
FIG. 7 illustrates a second embodiment of a seat assembly according to the present disclosure.

FIG. 7 illustrates an example of a seat 200 in which a plurality of back main bodies 214*a*, 214*b*, 214*c* are coupled to a single pan main body 212. The pan main body 212 comprises an extrusion 232 that extends further in the width direction W than does the first extrusion 32 of the examples of FIGS. 1-6. In other words, the extrusion 232 was cut to have a longer length than was the first extrusion 32. The pan main body 212 includes a pan hinge portion 264 formed as a groove, similar to the example described herein above. The pan hinge portion 264 is formed integrally at a rear end 244 of the extrusion 232. A back hinge portion 266*a*, 266*b*, 266*c* is formed on a lower end of the extrusions 234*a*, 234*b*, 234*c* of each back main body 214*a*, 214*b*, 214*c* in the plurality of back main bodies, respectively. The back hinge portion 266*a*, 266*b*, 266*c* of each back main body 214*a*, 214*b*, 214*c* fits together with the pan hinge portion 264 to pivotally couple each back main body 214*a*, 214*b*, 214*c* to the pan main body 212. Such coupling can be done in the same manner as that described herein above with respect FIG. 6. Each of the back main bodies 214*a*, 214*b*, 214*c* is independently pivotable with respect to the other back main bodies, and thus one, two, or all three of the back main bodies can be folded down in various configurations. Note that the back main bodies need not be as wide as shown herein, but could instead comprise extrusions that are only as wide as the second extrusion 34 shown in the example of FIGS. 1-6, and could be provided with back panels 18, such as shown above. Note also that the second embodiment of the seat 200 could also include the open profile on either or both of the pan main body 212 and the back main bodies 214*a*, 214*b*, 214*c*, such that further seat components, such as side rail 20*a* shown herein, can be connected thereto.

Figure 8:
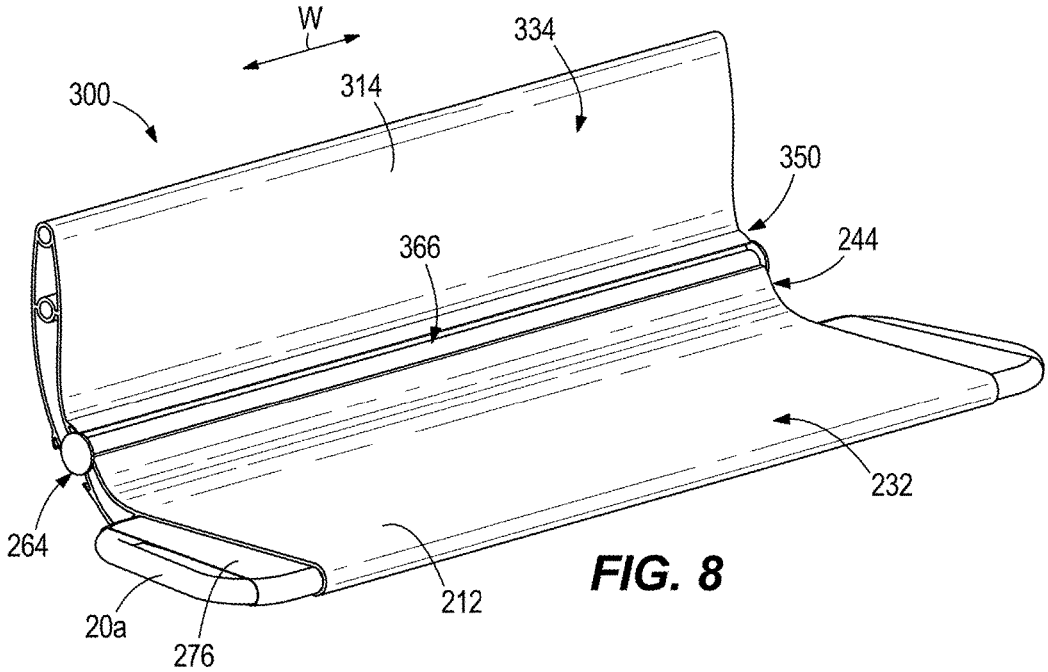
FIG. 8 illustrates a third embodiment of a seat assembly according to the present disclosure.

FIG. 8 shows a third embodiment in which only one back main body 314 is included in the seat 300, which is connected to the pan main body 212 at lower end 350 by way of back hinge portion 366. Otherwise, the rest of the components are similar to those described with respect to FIG. 7. The back main body 314 is made of an extrusion 334 that is wider than either the second extrusion 34 of the first embodiment or the extrusions 234*a*, 234*b*, or 234*c* of the second embodiment.

Thus, it can be seen that the extrusion 34, 234, 334 forming the back main body 14, 214*a*, 214*b*, 214*c*, 314, and the extrusion 32, 232 forming the pan main body 12, 212 can be cut to any length depending on the width of the seat 10, 200, 300 desired by the manufacturer. The same further seat components 98 described with respect to the seat assembly 96 in FIG. 3 can be attached to the extrusions 34, 234, 334, 32, 232, regardless of the length to which the extrusions are cut, thereby offering design flexibility with respect to seat width, comfort, functionality, etc. The open profiles 16, 30, 36 of the extrusions 34, 234, 334, 32, 232 described herein above can easily accept these further seat components 98 to fill out or build out the seat. This can help decrease manufacturing costs, because the pan main body 12 or the back main body 14 can be made less wide, if desired, and filled out with less expensive components. The seats 10, 200, 300 described herein above and below can be made of any material, such as, but not limited to, anodized aluminum or composite plastic. The seats could be fully upholstered or could have components that are left partially exposed, depending on the comfort and aesthetics desired by the manufacturer.

Thus, the present disclosure is of a seat assembly 96 for use in a boat and extending in a vertical height direction H, a lateral width direction W, and a depth direction D perpendicular to the width direction W. The seat assembly 96 includes a pan main body 12, 212 extending in at least the width direction W and the depth direction D. The pan main body 12, 212 is formed from a first single extrusion 32, 232 having a first uniform cross section in a first one of the height direction H, the width direction W, and the depth direction D. A back main body 14, 214*a*, 214*b*, 214*c*, 314 is coupled to the pan main body 12, 212 and extends in at least the width direction W and the height direction H. The back main body 14, 214*a*, 214*b*, 214*c*, 314 is formed from a second single extrusion 34, 234*a*, 234*b*, 234*c*, 334 having a second uniform cross section in a second one of the height direction H, the width direction W, and the depth direction D. At least one further seat component 18, 20*a*, 20*b*, 22*a*, 22*b*, 24*a*, 24*b*, 26, 28 is configured to be coupled to at least one of the pan main body 12, 212 and the back main body 14, 214*a*, 214*b*, 214*c*, 314.

At least one of the pan main body 12, 212 and the back main body 14, 214*a*, 214*b*, 214*c*, 314 has an open profile 16, 30, 36 when viewed in a respective first or second one of the height direction H, the width direction W, and the depth direction D. The open profile is configured to accept and hold the at least one further seat component 98 therein. The open profile of the at least one of the pan main body 12, 212 and the back main body 14, 214*a*, 214*b*, 214*c*, 314 is defined by a corresponding one of the first and second cross sections of the corresponding one of the first and second extrusions 32, 232, 34, 234*a*, 234*b*, 234*c*, 334. The open profile is defined by a first wall 38 or 46 and an opposing second wall 40 or 48 of the at least one of the pan main body and the back main body. A reinforcing rib 54, 56*a*, 56*b*, 58*a*, 58*b*, 60 is within the open profile and extends between the first wall and the second wall, as described herein above with respect to FIG. 4. The reinforcing rib at least in part defines a receiving area 62*a*, 62*b*, 62*c*, 62*d* for holding the at least one further seat component 98. According to the present disclosure, the open profile and the reinforcing rib both extend in the width direction W from a first lateral end to a second lateral end of the at least one of the pan main body and the back main body. For example, referring to FIG. 1, the first open profile 30 and reinforcing ribs 54, 56*a*, 56*b* extend from a first lateral end 88 of the pan main body 12 to a second lateral end 90 of the pan main body 12. Referring to FIG. 2, the second open profile 36 and the reinforcing ribs 58*a*, 58*b*, 60 extend from a first lateral end 92 of the back main body 14 to a second lateral end 94 of the back main body 14. Similarly, if the extrusion was extruded in the depth or height direction, the ribs would extend in the corresponding depth or height direction. As described herein above, a first further seat component, such as side rail 20*a*, can be held in a first receiving area 62*a*, 62*b* at the first lateral end (e.g., 88), and a second further seat component, such as side rail 20*b*, can be held in a second receiving area 62*a*, 62*b* at the second lateral end (e.g., 90). In other words, the first and second lateral ends 88, 90; 92, 94 of each of the extrusions 32, 34 are mirror images of one another such that further seat components 98 can be attached to either end of the extrusions. The same is true of the lateral ends of the extrusions 232, 234*a*, 234*b*, 234*c*, 334 shown in FIGS. 7 and 8.

Note that although back panel 18 is shown as being fastened to first wall 46 of back main body 14, back panel 18 could instead be attached via side rails that are inserted in the receiving areas 62*c*, 62*d* of the second extrusion 34 of the back main body 14, similar to the construction used for the pan of the seat 10. Any of the further seat components 98 could be slid over, snapped onto, adhered to, screwed or otherwise fastened to, or sandwiched between the pan main body 12, the back main body 14, and/or other seat components.

The seat assembly 96 further includes a pedestal assembly 28 configured to support the pan main body 12, 212 and extending in at least the height direction H. An attachment area 76 is formed integrally at a bottom side 78 of the first extrusion 32, 232 and is configured to receive and be coupled to an upper end 80 of the pedestal assembly 28. Note that for the seat 10 shown in FIGS. 1-6, only one pedestal assembly 28 is required. For the seats 200, 300 shown in FIGS. 7 and 8, more than one pedestal assembly 28 may be required to provide adequate support. Because the attachment area 276 shown therein is part of the extrusion 232, and therefore extends across the entire width of the pan main body 212, pedestal assemblies 28 can be attached to the attachment area 276 anywhere along the width of the extrusion 232. This allows for flexibility depending on floor space on the deck of the boat. Note that the attachment area 76 also extends in the width direction W along an entirety of the bottom side 78 of the first extrusion 32. In another example, a larger support that is designed as part of the vessel itself can hold the seat 200 or 300, such as is common for bench seating applications.

The seat assembly 96 further includes a first hinge portion 64, 264 formed integrally at a rear end 44, 244 of the first extrusion 32, 232. A second hinge portion 66, 266*a*, 266*b*, 266*c*, 366 is formed integrally at a lower end 50, 250, 350 of the second extrusion 34, 234*a*, 234*b*, 234*c*, 334. The first and second hinge portions fit together, such as described herein above with respect to FIG. 6, to pivotally couple the back main body to the pan main body. Again, because the first and second hinge portions are extruded as integral parts of the pan main body and the back main body, the first hinge portion 64, 264 extends in the width direction W along the rear end 44, 244 of the first extrusion 32, 232, and the second hinge portion 66, 266*a*, 266*b*, 266*c*, 366 extends in the width direction W along the lower end 50, 250, 350 of the second extrusion 34, 234*a*, 234*b*, 234*c*, 334. In one example, the hinge portions extend along an entirety of the rear and/or lower end of the first and/or second extrusions, respectively.

Figure 9:
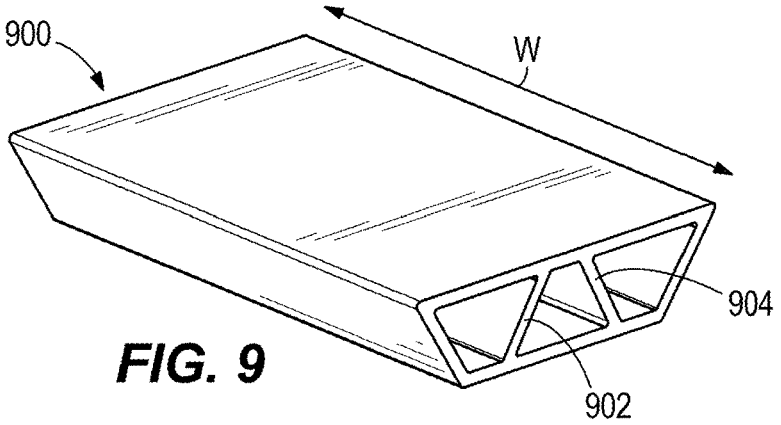
FIGS. 9-11 show alternative examples of a portion of the seat assembly that is extruded in various directions.

FIG. 9 illustrates another example of a main body 900 for a seat, which main body 900 is extruded in the width direction W and has a uniform cross section when viewed in the width direction W. Reinforcing ribs 902 and 904 create tubes that have different cross sectional shapes from those shown herein above in FIGS. 4 and 6. Note that although the main body 900 is oriented as it would be used for a pan main body, it could be used for a back main body that is extruded in the width direction W as well.

Figure 10:
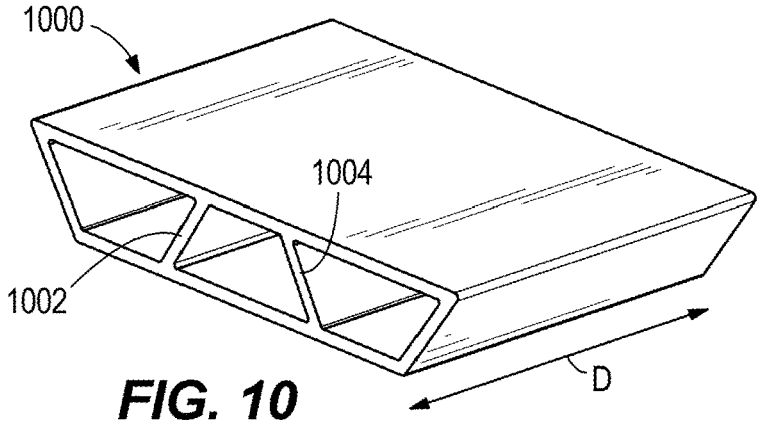

FIG. 10 illustrates an example of a main body 1000 that is extruded in the depth direction D and has a uniform cross section when viewed in the depth direction D. Reinforcing ribs 1002 and 1004 create tubes having the same shape as those shown in FIG. 9. In fact, the extrusions defining main bodies 900 and 1000 have the same cross sectional shapes. In other words, the orientation of the extrusion could depend on the desired application for the main body in question. Note that although the main body 1000 is oriented as it would be used for a pan main body, it could be used for a back main body as well, in which case it would have a cross section defined in the height direction. Orienting the extrusion in the width direction, as with main body 900, allows the width of the pan main body or the back main body to be cut to a desired dimension. Orienting the extrusion in a different direction, as with main body 1000, allows the depth of the pan main body or the height of the back main body to be cut to a desired dimension.

Figure 11:
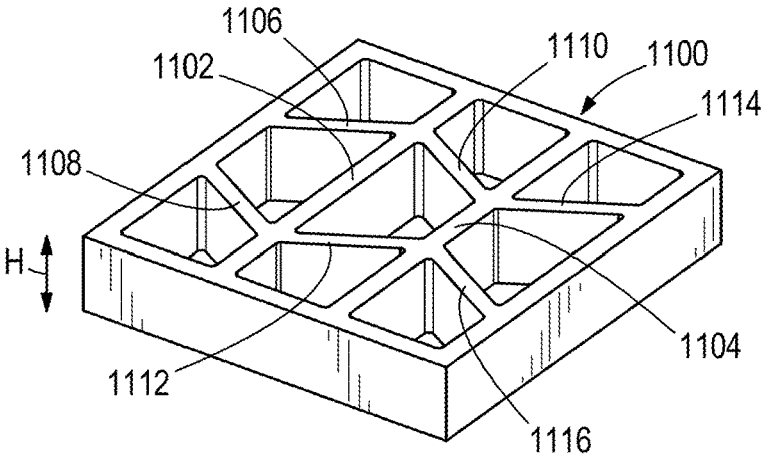

FIG. 11 shows a main body 1100 that is extruded in the height direction H. Two cross ribs 1102 and 1104 are connected to each other and to the outer sides of the main body 1100 by diagonal ribs 1106, 1108, 1110, 1112, 1114, and 1116. Note that although the main body 1100 is oriented as it would be used for a pan main body, it could be used for a back main body as well, in which case it would have a cross section defined in the depth direction.

Note that any of the main bodies and extrusion profiles depicted herein above could be used in various combinations. For example, the main body 1100 of FIG. 11 could be used with the main body 1000 of FIG. 10 or the main body 900 of FIG. 9. Additionally, the main bodies used for the pan and the back need not be extruded in the same direction as one another.

Thus, the seats 10, 200, 300 and seat assembly 96 described herein above use extruded back and pan substructures, which can be cut to length and then built upon using further seat components in order to customize boat seating options.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the appended claims. Each element in the appended claims is intended to invoke interpretation under 35 U.S.C. § 112(f), only if the terms "means for" or "step for" are explicitly recited in the respective element.

What is claimed is:

1. A seat for use in a boat and extending in a vertical height direction, a lateral width direction, and a depth direction perpendicular to the width direction, the seat comprising:

a pan main body extending in at least the width direction and the depth direction; and a back main body coupled to the pan main body and extending in at least the width direction and the height direction;

wherein at least one of the pan main body and the back main body is formed from a single extrusion having a uniform cross section in one of the height, width, and depth directions;

wherein at least one of the pan main body and the back main body has an open profile when viewed in the one of the height, width, and depth directions, the open profile being configured to accept and hold a further seat component therein;

wherein at least one of the pan main body and the back main body is both formed from the extrusion and has the open profile, and the cross section of the extrusion defines the open profile; and wherein the at least one of the pan main body and the back main body that is formed from the extrusion has a first wall and an opposing second wall that together define the open profile, and further comprising:

a reinforcing rib within the open profile that extends between the first wall and the second wall;

wherein the reinforcing rib at least in part defines a receiving area for holding the further seat component.

2. The seat of claim 1, wherein:

the pan main body is formed from a first single extrusion having a first uniform cross section in a first one of the height, width, and depth directions and has a first open profile when viewed in the first one of the height, width, and depth directions, the first cross section of the first extrusion defining the first open profile; and the back main body is formed from a second single extrusion having a second uniform cross section in a second one of the height, width, and depth directions and has a second open profile when viewed in the second one of the height, width, and depth directions, the second cross section of the second extrusion defining the second open profile.

3. The seat of claim 2, further comprising:
a first hinge portion formed integrally at a rear end of the first extrusion; and
a second hinge portion formed integrally at a lower end of the second extrusion;
wherein the first and second hinge portions fit together to pivotably couple the back main body to the pan main body.

4. The seat of claim 3, wherein one of the first hinge portion and the second hinge portion is formed as a groove extending in the width direction and the other of the first hinge portion and the second hinge portion is complementary to and fits within the groove.

5. The seat of claim 1, further comprising a plurality of back main bodies coupled to the pan main body.

6. The seat of claim 5, wherein the pan main body is formed from the extrusion, and further comprising:
a pan hinge portion formed integrally at a rear end of the extrusion; and
a back hinge portion formed on a lower end of each back main body in the plurality of back main bodies, respectively;
wherein the back hinge portion of each back main body fits together with the pan hinge portion to pivotably couple each back main body to the pan main body.

7. The seat of claim 1, wherein the pan main body is formed from the extrusion, and further comprising:
a pedestal assembly configured to support the pan main body and extending at least in the height direction; and
an attachment area formed integrally at a bottom side of the extrusion and configured to receive and be coupled to an upper end of the pedestal assembly.

8. The seat of claim 1, further comprising a plurality of further seat components configured to be accepted and held by the open profile, wherein the further seat components in the plurality of further seat components comprise at least one of the following:
a back panel;
a side rail;
an elastic seat suspension;
a plug; and
a cover fabric.

9. A seat assembly for use in a boat and extending in a vertical height direction, a lateral width direction, and a depth direction perpendicular to the width direction, the seat assembly comprising:
a pan main body extending in at least the width direction and the depth direction, the pan main body being formed from a first single extrusion having a first uniform cross section in a first one of the height, width, and depth directions;
a back main body coupled to the pan main body and extending in at least the width direction and the height direction, the back main body being formed from a second single extrusion having a second uniform cross section in a second one of the height, width, and depth directions;
a first hinge portion formed integrally at a rear end of the first extrusion; and
a second hinge portion formed integrally at a lower end of the second extrusion;
wherein the first and second hinge portions fit together to pivotably couple the back main body to the pan main body.

10. The seat assembly of claim 9, further comprising at least one further seat component configured to be coupled to at least one of the pan main body and the back main body.

11. The seat assembly of claim 10, wherein at least one of the pan main body and the back main body has an open profile when viewed in the respective first or second one of the height, width, and depth directions, the open profile being configured to accept and hold the at least one further seat component therein.

12. The seat assembly of claim 11, wherein the open profile of the least one of the pan main body and the back main body is defined by a corresponding one of the first and second cross sections of a corresponding one of the first and second extrusions.

13. The seat assembly of claim 12, wherein the open profile is defined by a first wall and an opposing second wall of the at least one of the pan main body and the back main body, and further comprising:
a reinforcing rib within the open profile that extends between the first wall and the second wall;
wherein the reinforcing rib at least in part defines a receiving area for holding the at least one further seat component.

14. The seat assembly of claim 13, wherein the open profile and the reinforcing rib both extend in the width direction from a first lateral end to a second lateral end of the at least one of the pan main body and the back main body, such that a first further seat component can be held in a first receiving area at the first lateral end, and a second further seat component can be held in a second receiving area at the second lateral end.

15. The seat assembly of claim 10, wherein the at least one further seat component comprises at least one of the following:
a back panel;
a side rail;
an elastic seat suspension;
a plug; and
a cover fabric.

16. The seat assembly of claim 10, further comprising:
a pedestal assembly configured to support the pan main body and extending at least in the height direction; and
an attachment area formed integrally at a bottom side of the first extrusion and configured to receive and be coupled to an upper end of the pedestal assembly.

17. The seat assembly of claim 16, wherein the attachment area extends in the first one of the height, width, and depth directions along an entirety of the bottom side of the first extrusion.

18. The seat assembly of claim 9, wherein the first hinge portion extends in the width direction along the rear end of the first extrusion, and the second hinge portion extends in the width direction along the lower end of the second extrusion.

19. A seat for use in a boat and extending in a vertical height direction, a lateral width direction, and a depth direction perpendicular to the width direction, the seat comprising:
a pan main body extending in at least the width direction and the depth direction; and
a plurality of back main bodies coupled to the pan main body, each back main body in the plurality of back main bodies extending in at least the width direction and the height direction;
wherein at least one of the pan main body and the back main bodies is formed from a single extrusion having a uniform cross section in one of the height, width, and depth directions;
wherein at least one of the pan main body and the back main bodies has an open profile when viewed in the one of the height, width, and depth directions, the open profile being configured to accept and hold a further seat component therein; and wherein the pan main body is formed from the extrusion, and further comprising:

a pan hinge portion formed integrally at a rear end of the extrusion; and a back hinge portion formed on a lower end of each back main body in the plurality of back main bodies, respectively;

wherein the back hinge portion of each back main body fits together with the pan hinge portion to pivotably couple each back main body to the pan main body.

* * * * *